United States Patent [19]

Nickipuck

[11] Patent Number: 4,480,511

[45] Date of Patent: Nov. 6, 1984

[54] LOCKING SOCKET WRENCH DRIVE DEVICE

[76] Inventor: Michael F. Nickipuck, 4525 S. DuBois, Brookfield, Ill. 60513

[21] Appl. No.: 260,350

[22] Filed: May 4, 1981

[51] Int. Cl.[3] ..... B25B 13/00

[52] U.S. Cl. ..... 81/177 G; 403/325

[58] Field of Search ..... 81/177 G; 403/325, 328, 403/358, 361

[56] References Cited

U.S. PATENT DOCUMENTS

| | | | |
|---|---|---|---|
| 2,162,359 | 6/1939 | Rhinevault | 81/177 G UX |
| 3,638,519 | 2/1972 | Rebold | 81/177 G |
| 3,924,493 | 12/1975 | Penner | 81/177 G |

*Primary Examiner*—James G. Smith

*Attorney, Agent, or Firm*—Brezina & Buckingham

[57] ABSTRACT

This invention relates to a socket wrench drive extension incorporating a quick release and locking feature. The extension is used in conjunction with a ratchet drive and standard mechanic's sockets for driving threaded fasteners. The invention utilizes a longitudinal control bar which bears directly or indirectly on a detent contained in a transverse bore at the driving end of the extension. The longitudinal control bar fits a channel machined into the exterior surface of the extension and is operated through the retraction of a spring loaded collar.

1 Claim, 9 Drawing Figures

LOCKING SOCKET WRENCH DRIVE DEVICE

BACKGROUND OF THE INVENTION

Socket wrenches incorporating ratchet drives and standard sockets for driving threaded fasteners including most commonly hexagonal nuts and bolt heads are commonly used in the mechanic's field. In situations where a mechanic is confronted with the requirement for driving a fastener located remotely from the place from which the mechanic must work or located in a tight space restricting the swing of the drive ratchet handle, extension drives are utilized to transmit the force from the ratchet to the socket. When driving a fastener in a remote location and particularly in a situation where the work must be accomplished in close quarters and with obstructions present, it is desirable to have a mechanism by which the socket can be locked to the extension. In addition to the desirability of a locking feature, it is necessary to provide for the rapid changing of sockets for driving various sizes of fasteners. In the environment in which a mechanic works, for example, in repairing vehicles or machinery, the mechanic often encounters an adverse environment involving temperature variations, corroded or damaged fasteners time pressures regarding the completion of jobs as well as oily and greasy conditions rendering a positive locking and releasing feature desirable. Under these situations, it is desirable for any mechanism to be simple and reliable as well as durable while providing an effective means of improving the efficiency of the work.

Another requirement for mechanic's tools is that they be relatively simple to manufacture and maintain.

Various methods are known by which fastener drive sockets can be affixed to mechanism with which to drive those sockets. Most of the known systems involve methods tailored to specific needs providing positive locking mechanisms for tools such as impact wrenches, where it is essential from a safety standpoint to have the sockets firmly attached to the drive. In these applications complicated machining may be utilized since the drive mechanisms are of a relatively large size and bulk providing adequate strength despite extensive internal machining. In addition, these mechanisms are all devised to be utilized in a location where the operator is provided ample work space and compactness of the mechanism is not an important factor. Known mechanisms incorporate locking means such as external rotating collars which are unsuitable for application in close quarters due to the possibility of accidental release from friction with obstructions (Rhinevault U.S. Pat. No. 2,162,353). Other mechanisms involve plungers as locking mechanisms which must be released utilizing a separate tool (Beers U.S. Pat. No. 2,954,934; Wendling U.S. Pat. No. 2,987,334). Other locking mechanisms involve the use of set screws, pins or other awkward releasing mechanisms requiring the removal of the socket from the fastener or workpiece and preventing rapid releasing of sockets in work in close quarters (Coffman U.S. Pat. No. 2,677,562).

One other type of mechanism known in an application similar to that for the instant invention is a push button release for a ratchet socket drive. This mechanism is unlike the invention in that it requires relatively complicated machining as does the other prior art, is relatively difficult to maintain and subject to malfunction from dirt or wear, is unsuitable for use on extensions because of the utilization of a central axial bore and pushbutton, and finally, involves application of both a downward pressure on a pushbutton plunger while requiring the resistance against which this force is applied as well as the simultaneous movement of the socket in the same direction as the pushbutton and in the direction opposite the resistance, which is an awkward motion for a mechanic in tight spaces. The pushbutton ratchet release also requires that the mechanism be machined out of larger pieces for the same strength as non-machined parts, rendering it frequently difficult to utilize the ratchet and socket combination alone in tight spaces (Smyers U.S. Pat. No. 3,762,245).

The invention provides for the utilization of the locking and quick releasing feature as a supplement to the ratchet handle which may be made smaller yet stronger than the cumbersome quick release type ratchet handle.

SUMMARY OF THE INVENTION

In accordance with the invention, a socket wrench drive extension is designed for use in conjunction with a ratchet drive handle and standard sockets for driving threaded fasteners. The extension incorporates a longitudinal control bar channel machined in one phase of the square drive portion of the socket and extending past the shoulder separating the driven portion from the extension portion of the device. A control bar is incorporated which is slidably mounted within the machined control bar channel, moving longitudinally therein. The lower end of the control bar is machined in the preferred embodiment being beveled at an angle of approximately 15°–30° being narrower at the lower of the control bar. The control bar comprises a flat portion contiguous to the inclined portion. The inclined portion is of a dimension longitudinally such that the lowermost portion of the control bar does not extend past the lower-most portion of the extension drive portion when the control bar is deflected fully forward or downward, while the upper edge of the inclined portion of the key at full forward or downward deflection does not extend as far as the bearing means which transmit the lateral force from the control bar to the detent and thereafter maintaining the socket in locked position until release. When the control bar is at full foward extension the flat portion of the key comes in contact with the locking ball bearing thereby locking the detent in position against the wall of the socket and the retainer grove machined therein.

A detent or retainer ball is slidably carried in the transverse aperture of the drive portion of the extension which when in locked position against the locking bearing ball and control bar exerts lateral force against the detent extending past the face in the square drive portion of the extension opposite the face into which the control bar channel is machined. The lateral extension of this detent mates with standard recesses machined in the drive walls of standard sockets and prevents the downward or forward movement of said sockets. The outward extension of the detent further serves to lock the socket in position with relation to the drive axis of the extension in that lateral pressure is exerted on the drive wall of the socket by the detent in its locked position and the control bar along the opposite face of the drive wall of the socket.

Longitudinal movement of the control bar from the locked to the released position is accomplished by the rearward movement of the sleeve. The rearward force is transmitted to the control bar through the utilization of a spur or appendage in the control bar from a slidably mounted collar located some distance up the extension from the drive portion of the extension. The rearward motion of the slidably mounted collar is accomplished by moving said collar rearward against the forward spring pressure of the helical spring enclosed by the collar and wound around the body of the extension itself.

The mechanism is maintained in its locked position through the use of a spring exerting forward or downward pressure against the release collar and locked in its forward extension through the use of circular clip ring or clamp.

Other objects and advantages of this invention will be apparent from the following description, the accompanying drawing, and the eight claims.

DETAILED DESCRIPTION OF THE PREFERRED EMBODIMENT

Figure 1:
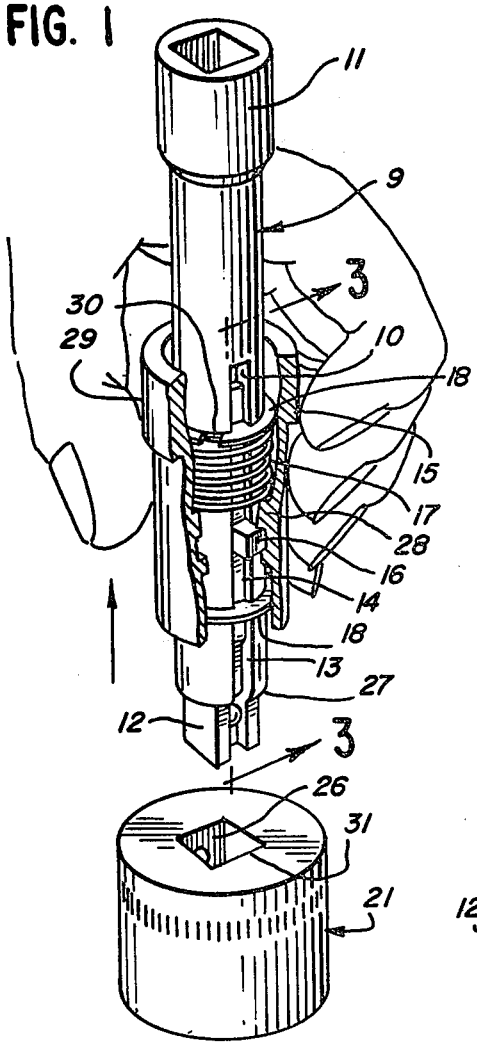
FIG. 1 is a perspective view of the invention and a standard socket in the released position.

The drawings appended hereto illustrate in FIG. 1 a socket wrench drive extension including a driven portion of the socket drive extension 11, the socket wrench drive extension shank 9, and the driving portion of the socket wrench drive extension 12. The socket wrench drive extension is designed to be driven by the square drive portion of a standard ratchet handle mating with the drive portion 11. The socket wrench drive extension 12 drives a standard socket 21 which mates with the driving portion of the socket wrench extension 12.

Machined in the surface of the socket wrench drive extension shank 9 is a control bar channel 10 which channel extends to a substantial portion of the shank 9 and through the shoulder 27 between the shank 9 which is cylindrical in cross-section and the driving portion 12 which is square in cross-section. The control bar 14 includes the outer positive locking and centering portion 13 at its lower end. The sleeve engagement spur 16 is an integral part of the control bar 14 which are located equidistant from the end of the control bar and serves to engage the control bar with the sleeve 15.

The sleeve 15 includes internally machined control bar engagement spurs 28 which transmit motion from the sleeve 15 to control bar 14. Internal of the sleeve is a helical spring 17 which bears on the upper portion of the control bar engagement means 28 at the lower end of the spring 17 while being retained by a C-clip 19 fitting a groove 30 machined in the circumference of the drive extension shank 9.

The helical spring 17 is shown in its compressed position in FIG. 1 as the sleeve 15 is pulled axially toward the driven end of the extension shaft 11 and away from the driving end of the extension shaft 12 through a force exerted directionally upward or backward by the user against the grippable portion 29 machined into the exterior of the sleeve. The rearward displacement of the sleeve and connected control bar accomplish the operation as demonstrated in greater detail in FIGS. 3 and 4. The control bar release face 25 then releases the ball detent mechanism thereby releasing the standard fastener driving socket wrench 21.

Figure 2:
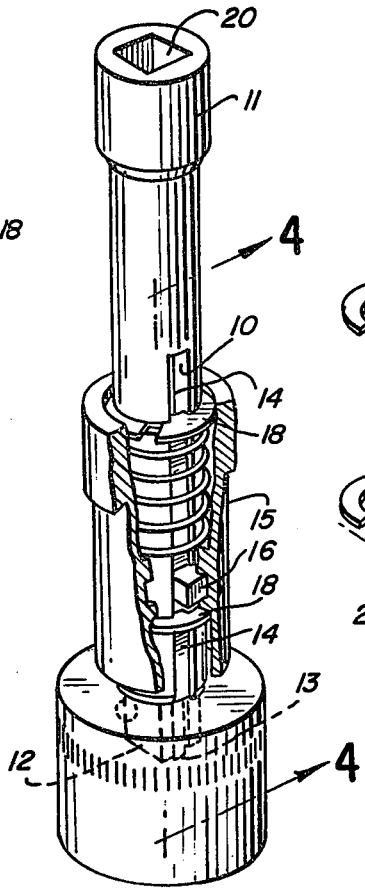
FIG. 2 is a perspective view of the invention and a standard socket in the locked position.

FIG. 2 is a perspective view which shows the preferred embodiment in position for use with the sleeve 15 released by the user and forced downward by the spring 17. As the sleeve 15 is forced downward it in turn forces the control bar 14 downward through the engagement spurs 16 and 28 which displaces the locking mechanism outward and retains the socket 21 in a locked position.

The maximum extension of the control mechanism including the sleeve 15, spring 17 and control bar sleeve engagement spur 16 is restricted by a C-clip or circlip 18 fitted in a circumferential groove 30 machined in the shank 9 of the extension drive shaft.

Figure 3:
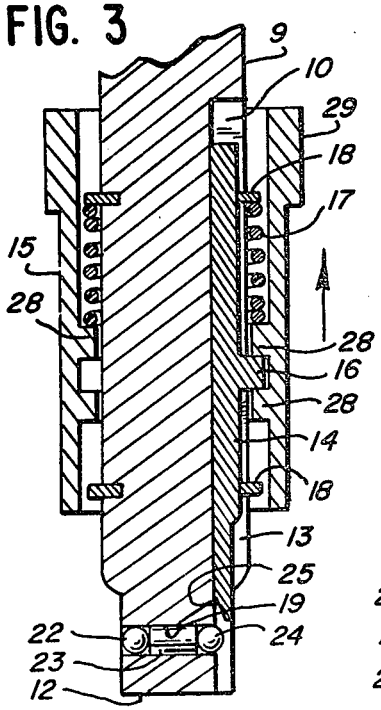
FIG. 3 is a fragmentary sectional view of the invention in its released position.

FIG. 3 is a fragmentary cross-sectional view of the preferred embodiment showing the lower portion of the drive extension shank 9, the square driving portion of the socket wrench drive extension shaft 12. The entire control mechanism, a sleeve bar engagement means 28, bar sleeve engagement means 16, control bar 14, spring 17, and C-clips 18 as shown in this sectional view.

Also shown in sectional view FIG. 3 is the lower locking portion of the control bar 14 which comprises the outer positive locking and centering portion of the control bar 13, as well as the beveled release surface of the control bar 25. Apparent in this sectional view is the transverse bore 19 positioned in such a way to intersect the control bar channel 10. This transverse bore is knurled or otherwise machined at either end to decrease the diameter of the bore so as to retain the locking bearing ball 24 the tie in shaft for transmitting the locking force to the retainer ball 23, and the retainer ball 23.

FIG. 3 shows the preferred embodiment in the spring-compressed position as in FIG. 1 which permits the retainer mechanism ball bearings 22 and 24, and force transmission shaft 23 free to be displaced radially through the transverse bore toward the control bar channel thereby permitting the removal of the socket.

As can be seen in FIG. 3 the C-clips 18 further serve to provide radial pressure against the outer surface of the control bar 14 to prevent its displacement outward, as does the inner wall of the sleeve 15.

Figure 4:
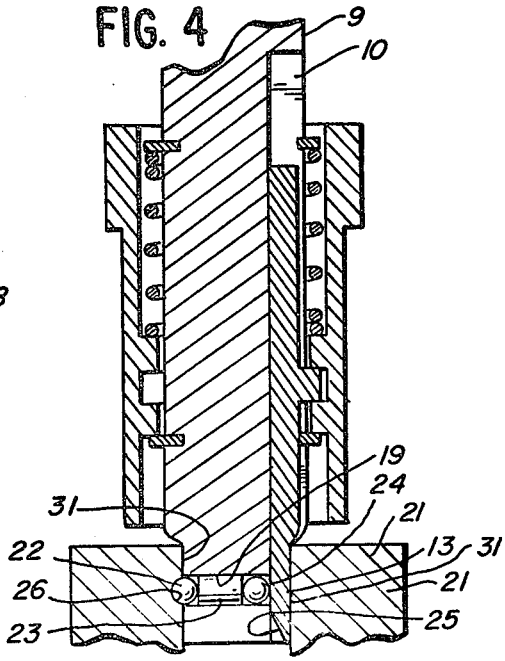
FIG. 4 is a fragmentary sectional view of the invention in its locked position shown in conjunction with a standard socket.
Figure 6:
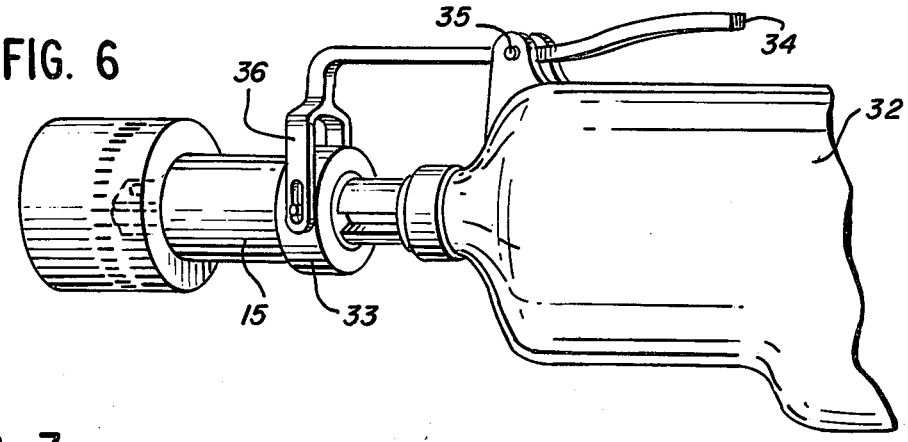
FIG. 6 is a perspective view of an alternative embodiment in which the sleeve 15 is non-rotatably mounted relative to the drive shaft of a power driven socket wrench 32. In this embodiment the sleeve itself is mounted in a rotating bearing 33 through which the downward or rearward force is transmitted through a mechanism pivotally mounted at 35 on the casing of the power driven socket wrench, which mechanism utilizes a semi-circular yoke 36 around the drive shaft and sleeve. The exertion of force on the release lever 34 is transmitted through the bearing to the sleeve which in turn transmits the force through a mechanism as described in FIGS. 1–5 which provides a ready and quick means of releasing said sockets.
Figure 7:
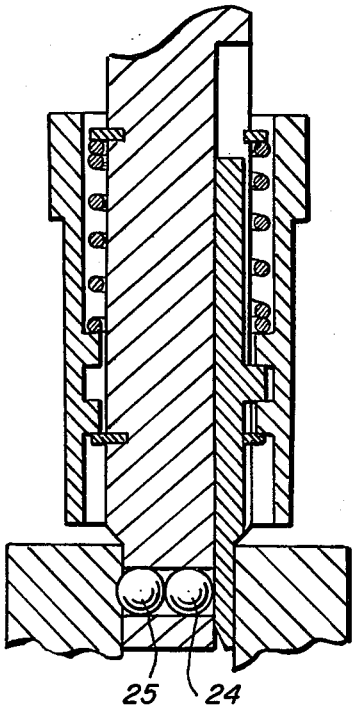
FIG. 7 is a fragmentary sectional view of another embodiment in which the locking ball bearing 24 bears directly on the retainer ball 25 dispensing with the force transmission shaft.
Figure 8:
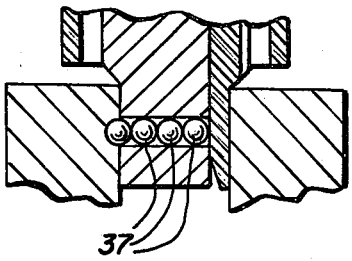
FIG. 8 is a fragmentary sectional view of another embodiment in which multiple ball bearings 37 are utilized to transmit force from the control bar to the retainer ball.
Figure 9:
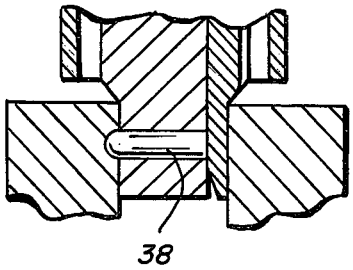
FIG. 9 is a fragmentary sectional view in which a cylindrical detent 38 is utilized, extending completely through the transverse bore.

FIG. 4 is fragmentary sectional view showing the features as described in FIG. 3 as well as the drive socket 21 which includes a recess 25 against which the retainer ball bearing 22 is forced through operation of the control bar.

FIG. 4 shows the spring 17 in its extended configuration forcing the sleeve 15 downward through operation of the engagement spurs 28 and 16 to its maximum extension is restricted by the C-clips 18. Through the operation of the engagement spurs 28 and 16 the control bar 14 is also extended downward to its maximum operating extention point. Through the range of motion of the control bar downward the beveled release surface 25 of the control bar applies constant force across the ball bearings 24 which through the force transmission shaft 23 extends the retainer ball 22 progressively farther outward on the opposite face the square socket drive portion 12. It is important to have the angle of the beveled release surface 25 and the distance between the widest portion of the beveled surface 25 and the narrowest portion of proper dimensions so as to displace the locking mechanism far enough to permit the locking of standard sockets by using a dimension appropriate given the standard dimension of the socket locking depression.

As downward or forward most extension of the control bar 14 occurs and outward most displacement of the locking mechanism 24, 23 and 22 occurs the flat interface of the control bar 31 prevents further transverse movement of the locking mechanism 22, 23 and 24 by virtue of the fact that the force is acting approximately 90° in relationship to the locking surface of the control bar 32.

In the locked position the outer positive locking and centering portion of the control bar 13 is in contact with the inner drive wall 31 of the square drive on the standard socket 21. Because of the positive locking nature of the locking mechanism any downward force on the socket while in the locked position is distributed evenly through the retainer ball 22 force transmittal shaft 23 and locking ballbearing 24 through the positive locking and centering portion of the control ball 13 to provide even forces on opposite inner walls 31 of the square drive of a standard socket which serves to center the socket so that as rotational forces act on the entire mechanism through the socket wrench drive extension shaft these forces are distributed approximately equally on or near each corner of the walls of the driving portion of the socket wrench drive extension shaft 12 and the driven inner walls 31 of the standard socket wrench 21. The centering action is desirable in general to transmit equal rotational forces and in particular in cases where the driven inner walls of standard sockets suffer from wear or being oversized.

Figure 5:
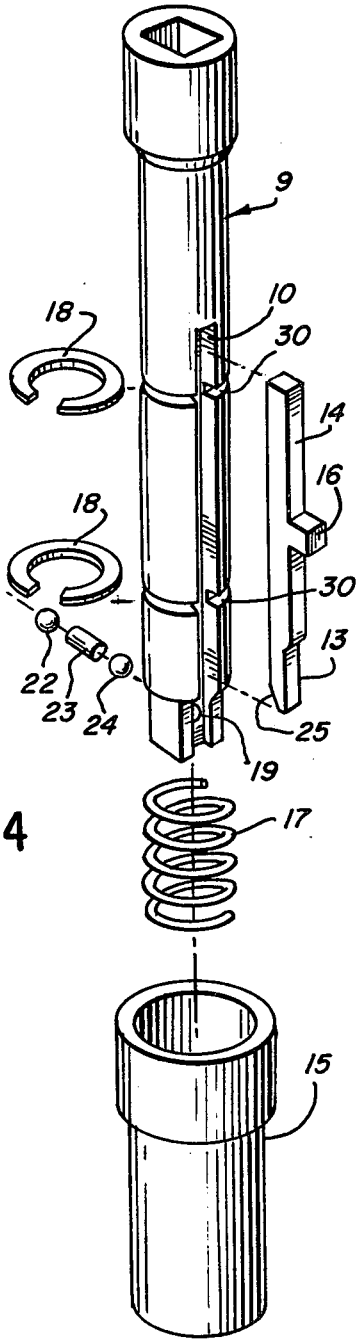
FIG. 5 is an exploded perspective view of the invention showing its parts in relation to each other.

FIG. 5 is a perspective exploded view of the preferred embodiment showing the parts separately in relation to each other.

In another embodiment the sleeve 15 is non-rotatably mounted relative to the drive shaft of a power driven socket wrench. In this embodiment the sleeve itself is mounted in a rotating bearing through which the downward or forward force in transmitted through a mechanism pivotally mounted on the casing the power drive socket wrench which mechanism utilizes a semi-circular yoke around the drive shaft and sleeve. The exertion of downward or forward force on the release lever is transmitted through the bearing to the sleeve which in turn transmits the force through a mechanism as described in FIGS. 1–5 which provides a positive locking mechanism for high speed power driven sockets yet provides a ready and quick means of releasing said sockets.

In another embodiment the locking ball bearing bears directly on the detent ball dispensing with the force transmission shaft 23.

In another embodiment multiple ball bearings are utilized to transmit force from the control bar to the retainer ball.

I claim as my invention:

1. In a socket wrench drive extension, a shank with driving and driven means at opposite ends; a release control sleeve incorporating inner control bar engagement means, a helical coil spring carried external of the shank and internal of the sleeve said sleeve forced downward by said helical spring into a positive locking position, said sleeve being displaced upwardly by the action of a user in the direction opposite from the direction in which the socket is moved to remove it from the tool; a longitudinally extending control bar channel machined into the surface of the shank of the socket wrench drive extension; a control bar slidably mounted in said control bar channel with sleeve engagement means, a beveled release surface on the lower end of the control bar, an inner locking surface contiguious to said beveled release surface and a flat outer positive locking and centering portion on the opposite face of the control bar from said inner locking surface, said control bar outer positive locking and centering portion performing a flat plane in conjunction with one driving face of the square driving portion of the socket wrench drive extension; a transverse bore through the shank intersecting the control bar channel at approximately 90° thereto and extending completely through the driving portion of the socket wrench drive extension to the opposite face; a retainer ball slidably carried in said transverse bore; a locking bearing ball transmitting force from the control bar release surface through force transmission means, force transmission means slidably carried in the transverse bore between said retainer ball and said locking bearing ball to outwardly displace the retainer ball; said retainer ball extending beyond the face of the driving portion of the socket wrench drive extension opposite the face which forms flat plane in conjunction with the outer positive locking and centering portion of the control bar, said retainer ball extension through the driving face sufficient to engage in a standard recession machined on the inner driven walls of standard fastener drive sockets, said retainer ball further transmitting force exerted downward on standard fastener drive sockets and on said retainer ball respectively, horizontally evenly through the locking mechanism to the control bar and thence providing equalized lateral forces on the opposite drive inner faces of a standard square drive fastener driving socket, said equalized forces providing for a centering action in oversized and worn sockets and therefore, equalizing stresses caused by the application of tensional forces through the drive mechanism to the socket.

* * * * *